US008656844B2

(12) United States Patent
Ceballos-Godefroy

(10) Patent No.: US 8,656,844 B2
(45) Date of Patent: Feb. 25, 2014

(54) COVER FOR BASE OF COUNTER

(76) Inventor: Ricardo Ceballos-Godefroy, Colonia del Valle (MX)

( * ) Notice: Subject to any disclaimer, the term of this patent is extended or adjusted under 35 U.S.C. 154(b) by 0 days.

(21) Appl. No.: 13/511,752

(22) PCT Filed: Nov. 22, 2010

(86) PCT No.: PCT/IB2010/002976

§ 371 (c)(1),
(2), (4) Date: Aug. 9, 2012

(87) PCT Pub. No.: WO2011/064643

PCT Pub. Date: Jun. 3, 2011

(65) Prior Publication Data

US 2012/0297688 A1 Nov. 29, 2012

(30) Foreign Application Priority Data

Nov. 25, 2009 (MX) ..... MX/a/2009/012756

(51) Int. Cl.
*A47B 3/00* (2006.01)

(52) U.S. Cl.
USPC ..... 108/115; 108/157.1

(58) Field of Classification Search
USPC ..... 108/115, 25, 33, 34, 35, 37, 38, 41, 108/162, 164, 166, 172, 180, 182, 186, 193, 108/153.1, 157.1, 157.14, 157.15, 157.16, 108/157.18, 159, 159.11, 158.12; 312/108, 312/118, 226, 244, 280
See application file for complete search history.

(56) References Cited

U.S. PATENT DOCUMENTS

| | | | | | |
|---|---|---|---|---|---|
| 2,131,122 | A | * | 9/1938 | Schlett | 108/14 |
| 2,808,305 | A | * | 10/1957 | Jackson | 312/140.2 |
| D257,093 | S | * | 9/1980 | Brittner | D6/481 |
| 4,417,774 | A | * | 11/1983 | Bevan et al. | 312/108 |
| D330,294 | S | * | 10/1992 | Carr | D6/419 |
| 5,382,087 | A | * | 1/1995 | Pouch | 312/140.2 |
| 5,402,738 | A | * | 4/1995 | Carr et al. | 108/157.1 |
| D357,830 | S | * | 5/1995 | Englander et al. | D6/481 |
| 5,454,331 | A | * | 10/1995 | Green | 108/180 |
| 5,785,046 | A | * | 7/1998 | Colla | 126/9 R |

(Continued)

FOREIGN PATENT DOCUMENTS

| | | | |
|---|---|---|---|
| BE | 904965 | A1 | 10/1986 |
| DE | 29620123 | U1 | 4/1997 |

(Continued)

OTHER PUBLICATIONS

International Search Report; International Application No. PCT/IB2010/002976; International Application Filing Date Nov. 22, 2010; Mail date Mar. 2, 2011.

*Primary Examiner* — Jose V Chen
(74) *Attorney, Agent, or Firm* — Cantor Colburn LLP

(57) ABSTRACT

A cover for a base of a counter is disclosed; the cover is mounted on the base; in the cover it is inserted at least one post that supports a board; the cover comprises a lower section that has a lower face provided with a recess where the base is coupled when it is in upright position; and an upper section with an upper face, where it is provided at least one hole where the post is inserted; the upper section being hingedly connected to the lower section in such a way that they close with each other so that the cover becomes a housing where the base may be stored.

10 Claims, 7 Drawing Sheets

(56) References Cited

U.S. PATENT DOCUMENTS

| | | | | |
|---|---|---|---|---|
| 5,954,412 | A * | 9/1999 | Rutherford et al. | 312/258 |
| 6,039,419 | A * | 3/2000 | Brown et al. | 312/262 |
| 6,189,594 | B1 * | 2/2001 | Carter | 160/135 |
| 6,470,811 | B1 * | 10/2002 | Isinger | 108/153.1 |
| 6,523,485 | B1 * | 2/2003 | Cipolla | 108/14 |
| 6,612,669 | B2 * | 9/2003 | Grueneberg | 312/259 |
| 7,101,000 | B2 * | 9/2006 | DeMars | 312/140.2 |
| 7,494,196 | B2 * | 2/2009 | Franco | 312/257.1 |
| 7,533,940 | B1 * | 5/2009 | Zook | 297/440.13 |
| 8,015,928 | B2 * | 9/2011 | Chen | 108/35 |
| 8,113,605 | B2 * | 2/2012 | Ceballos-Godefroy | 312/262 |
| 2003/0085640 | A1 * | 5/2003 | Chan | 312/262 |

FOREIGN PATENT DOCUMENTS

| | | | | |
|---|---|---|---|---|
| DE | 29814733 | U1 | 3/1999 | |
| ES | 284888 | | 7/1985 | |
| FR | 2786080 | A1 | 5/2000 | |
| GB | 2241637 | A * | 9/1991 | A47B 43/00 |
| MX | PA03000030 | A | 6/2004 | |
| WO | 2006136874 | A1 | 12/2006 | |

* cited by examiner

COVER FOR BASE OF COUNTER

TECHNICAL FIELD OF THE INVENTION

The present invention relates to the techniques employed in the manufacture and design of furniture, counters and displays where products and services are offered and, in particular, the invention relates to a cover for the base of a counter, in which the cover is mounted on the base. In the cover, a post is inserted, which supports a board forming the counter. In the present invention, the cover is designed to work as a fully closed container in order to store the other pieces of the counter when the same is not in use.

BACKGROUND OF THE INVENTION

In many places where public gather for the acquisition and exposure of products and services, such as fairs, conventions, information centers and so on, there is a need to use furniture and counters for the public that approach to the suppliers that present their products to them. In this regard, there is an important variety of such furniture, e.g. wooden-made, metallic, furnished with shelves, partitions; in general terms, though, they are bulky, difficult to handle and transport thereof results in hardships since they take up a lot of space.

In the prior art, one known solution to such problems has involved the creation of carton folding furniture and counters, nevertheless, their structural rigidity is poor and, furthermore, it is not possible placing heavy things on them. In addition, this type of carton-made furniture lacks of an outstanding aesthetical appearance, which is an important factor to achieve a commercial impact of the product or service being supplied.

There also exists furniture with countless panels, rods and posts that cooperate each to other; however, assembly thereof is time-consuming and the pieces to be assembled are too many.

Despite the above, there are counters that have been broadly accepted and which are practical to use for such purposes, among them there are those counters that comprise a base and a cover mounted on the base and a board mounted on at least one post that is inserted in the cover. In this type of counters, the board helps to identify the name of the supplier or the product being offered, while the supplier is located behind the counter to receive the customers approaching the counter.

One of such counters is disclosed in Mexican Patent No. 212,227, whose most significant advantage is that the counter elements can be demounted and stored in the form of a briefcase, in which the cover forms a shield for said briefcase and the base is housed within; at the same time, the other pieces of the counter are also housed therein.

The counter of the above-mentioned patent was restructured in Mexican patent No. 225,710, wherein the most significant changes are the inclusion of 45° cuttings between the post sections that support the board and a second shelf that runs on a rail, in addition there is provided a support to secure the post sections within the second shelf. In spite of such modifications, the board is still unstable since it sways over the cover; furthermore, the shelves frequently fall off their horizontal position because at their free side ends the shelves are secured only by pressure between the side panels of the base.

In the international patent application No. PCT/IB2005/002083, there are provided a series of modifications to the counter of Mexican Patent No. 225,710, and such modifications relate to the inclusion of means for supporting the shelves firmly so that they do not move, either that the counter is in an upright position or folded.

In this type of counters, the cover is an independent piece that must be manipulated to mount it on the base, and serves as a housing for the folded base, this action may become complicated for some people, apart from the fact that it takes time to do these operations.

Structurally, the cover of these counters includes a rear wall or cap hingendly connected to the rest of the cover body, this feature is aimed to allow the base, once folded, to be introduced into the cover, which is closed when taking the rear wall to its original position and fixed it by means of locks to the rest of the cover body. As it may be observed, this type of covers includes an important amount of pieces that must be machined independently to be assembled all together, therefore their cost and manufacturing time is increased.

An additional disadvantage of this cover is that when pieces of the counter are stored into the cover, the base remains exposed and it may be susceptible to have scratches and scraps on its surface.

As it may be observed, the cover of the counters of the previous arte plays a substantial role, since it is the part where the other parts of the counter are stored, and products to offer are placed on it. New covers that are easy to build and that still allow to house the other elements of the counter are required.

SUMMARY OF THE INVENTION

Pursuant to the above, the purpose herein has been to overcome the drawbacks of the covers of counters on which the base is of the type comprising a left side panel; a left front panel hingendly connected to the left front panel; a right front panel hingendly connected to the left front panel; and a right side panel hingendly connected to the right front panel, where the base has a upright up position and a folded position. In the cover, at least one post supporting a board is inserted.

Particularly, the cover of the present invention comprises a lower section that has a lower face where there is provided a recess in which the base couples when it is in an upright position. The other part of the cover is an upper section with an upper face where there is at least one upper hole where the post is inserted.

The upper section is hingendly connected to the lower section in such a way that one closes against the other one the cover becomes a fully closed housing or container where the base is stored in its folded position, so having as an advantage that the base is no longer exposed as in the previous art.

In one embodiment of the invention, the cover comprises means for locking the lower section with the upper section, so avoiding it from opening, either when the cover is mounted on the base or when, the base is housed into the cover. The locking means may be provided in some or in both of said lower or upper sections.

Likewise, in another embodiment of the invention, the cover also comprises, holding means in order to hold the cover and load it once the base of the counter is housed in it, said holding means are provided in some or both, the lower or upper sections. Particularly, it is preferred to use a handle as locking means, where, preferably, the handle is integrally formed in the cover.

Particularly, it is preferred that the cover of the present invention may be made of a thermoformable material in order to make its construction easier, so having a wide variety of shapes, some of them capricious, making the counter more attractive when it is in use.

In another preferred embodiment, the lower section of the cover includes at least a lower hole so that the post that is inserted through the upper hole crosses all the cover and comes out through the lower hole in order to be inserted in the front panel or some of the side panels of the base, with this feature, it is reached more stability to all the counter when it is fully assembled.

In one aspect of the invention, a counter is provided, which includes the cover as it has been defined previously, a base where the cover is mounted; at least one post inserted in the cover; and a board that coupled on the post.

BRIEF DESCRIPTION OF THE DRAWINGS

Novel aspects featured by the present invention shall be set forth in connection with the appended claims. Nevertheless, the invention itself shall be better understood regarding its structure, as well as other objects and advantages of the same, with the following detailed description of a preferred embodiment thereof, when read in conjunction with the appended figures, in which:

DETAILED DESCRIPTION OF THE PREFERRED EMBODIMENT OF THE INVENTION

Figure 1:
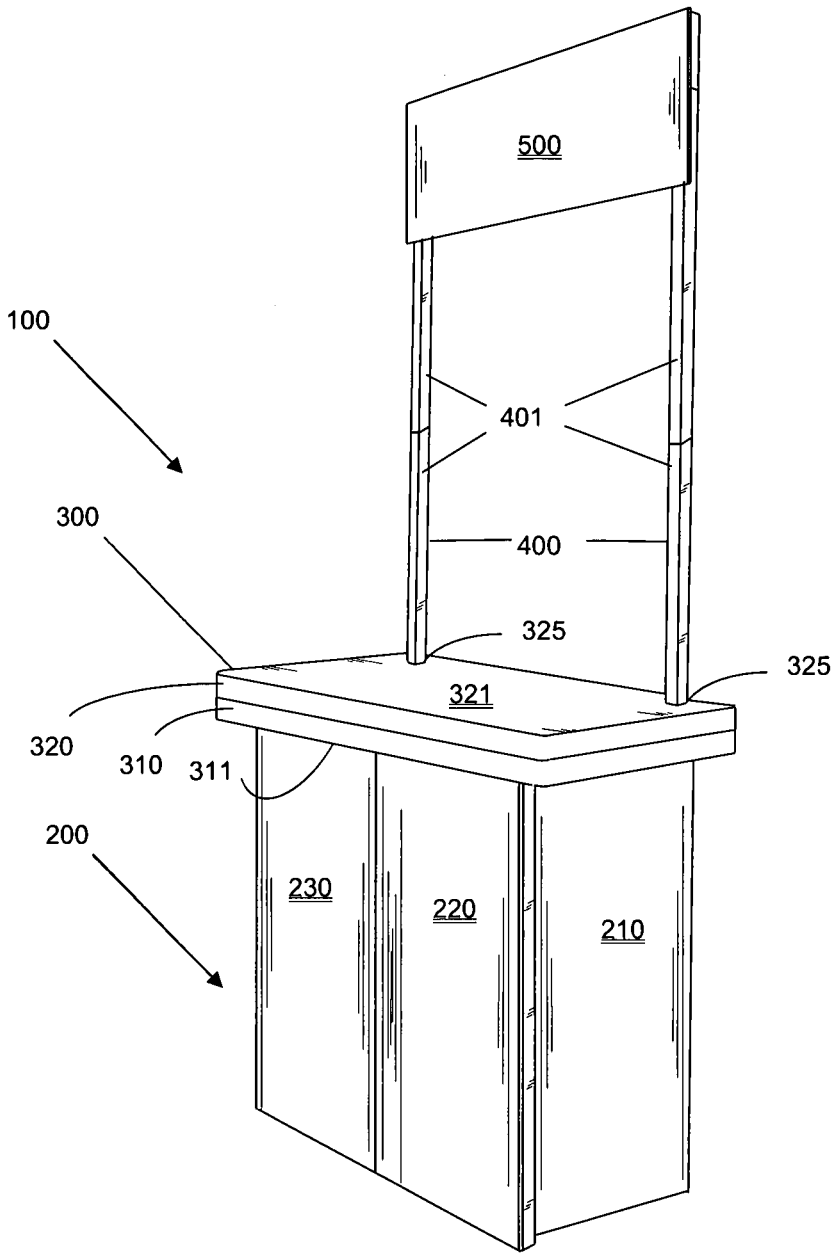
FIG. 1 is a front and upper perspective view of a counter with a cover built according to a preferred embodiment of the present invention.
Figure 2:
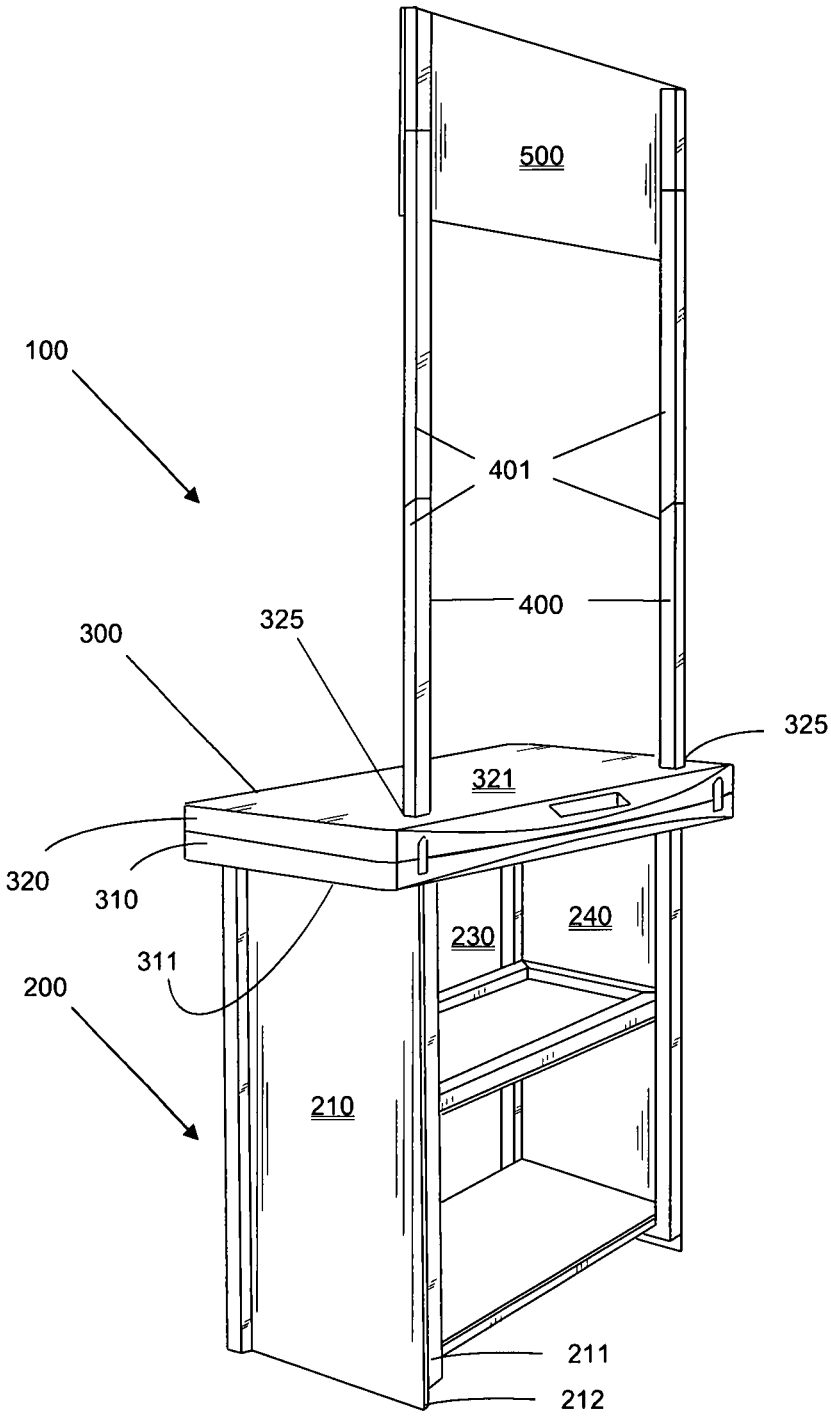
FIG. 2 is an upper and rear perspective view of the counter of FIG. 1.
Figure 3:
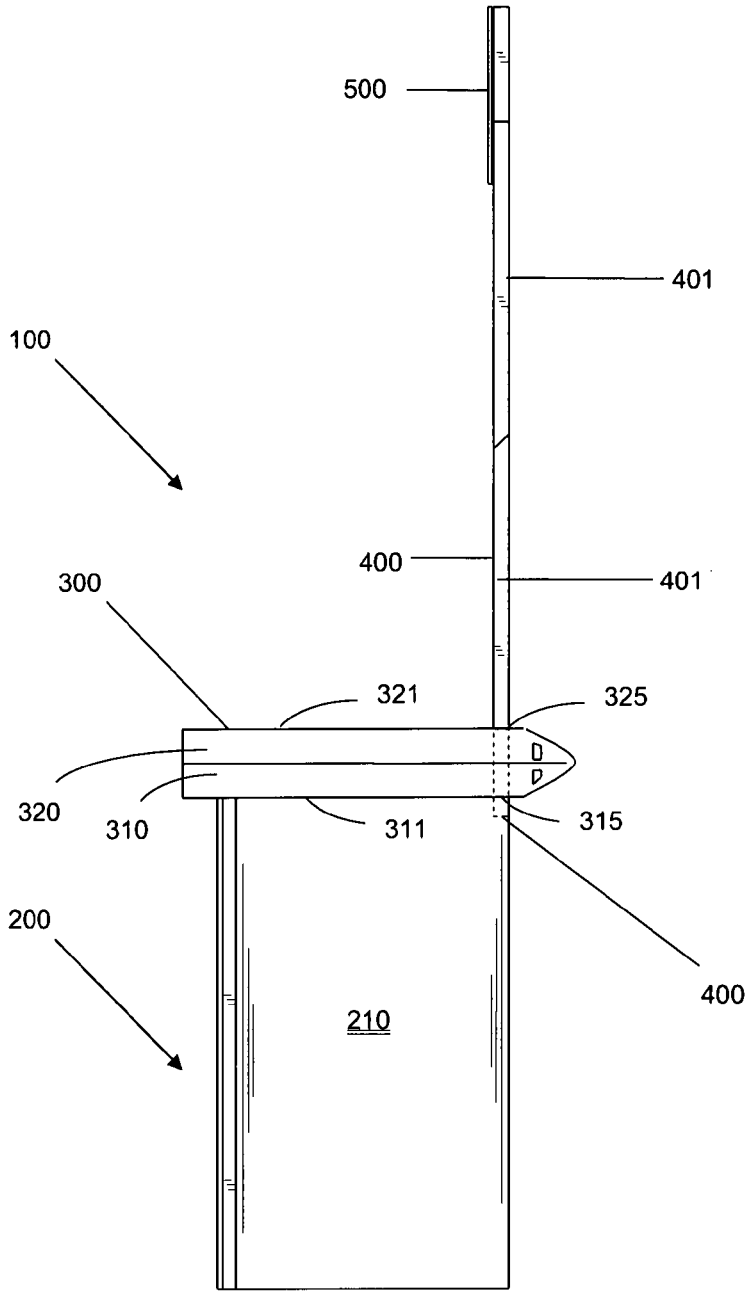
FIG. 3 is a left side view of the counter shown in FIG. 1.

With reference to the accompanying drawings and more specifically, to FIGS. 1 to 3 thereof, in them there is shown a counter 100 comprising a base 200 formed in turn by a left side panel 210; a left front panel 220 hingedly connected to the left side panel 210; a left front panel 220 hingendly connected to the left side panel 210; a right front panel 230 hingendly connected to the left front panel 220; and, a right side panel 240 hingendly connected to the right front panel 230.

The base 200 has an "upright" position as that illustrated in FIGS. 1 to 3, where the cover 300 is mounted on the base; the base also has "folded" position where front panels 220, 230 and side panels 210 and 240 are folded one next to the other, in an accordion form, particularly the side panels 210 and 240 are housed inside the front panels 220 and 230 in order to reduce the volume of the base 200 once the same is folded.

Each of the front panels 220, 230, as well as each of the side panels 210 and 240 comprises a frame and a plate adhered to the frame, for example, the left side panel is formed by the frame 211 and the plate 212 (see FIG. 2). The front panels 220, 230 and the side panels 210, 240 are connected by means of piano type hinges or plastic hinges that connect their side edges, the construction of this type of bases is disclosed in the application PCT/IB2005/002083, which is incorporated herein as reference.

It is convenient to mention that the base 200 illustrated in FIGS. 1 to 3 is just an example of a base for counters in which the cover of the present invention may be used. There are bases well known by such skilled in the art, in which the cover of the present invention may be mounted, and even recently, bases with doors and/or wheels have been designed, just as that one disclosed in the Mexican Patent Application No. MX/a/2009/007899.

The counter 100 where the new cover 300 is used, also includes at least one post 400 formed by a pair of sections 401, upper and lower, which are coupled each to other. The posts 400 support a board 500, which may also be also supported by only one post 400 and, even, each post 400 may be made in one sole piece. The counter 100 of the FIGS. 1 to 3 is a typical example, in which the cover of the present invention may be included, which is described in detail in the following paragraphs.

The cover 300 of the preferred embodiment of the present invention comprises a lower section 310 that has a lower face 311; and an upper section 320 with an upper face 321 where there are provided upper holes 325 in which the posts 400 are inserted. The upper section 320 closes with the lower section 310 forming a housing that is mounted on the base 200 as it shown in FIGS. 1 to 3. Within the cover 300, it is possible to introduce small objects that do not need to be used at the moment when the counter is used, so two advantages are reached in comparison with the previous art.: i) appearance of all the counter is improved and ii) there is a closed space within the cover to store items safely.

FIG. 3 shows that the lower section 310 includes a lower hole 315 so that the post 400 is inserted through the upper hole 325 crossing all the cover 300 and coming out from the lower hole 315 in order to be inserted into the left side panel 210 of the base, therefore it is achieved more stability for all the counter 100, as a whole, when it is assembled. On the opposite side of the counter 100 of FIG. 3, there is an identical relationship between the remaining post and the right side panel.

Figure 4:
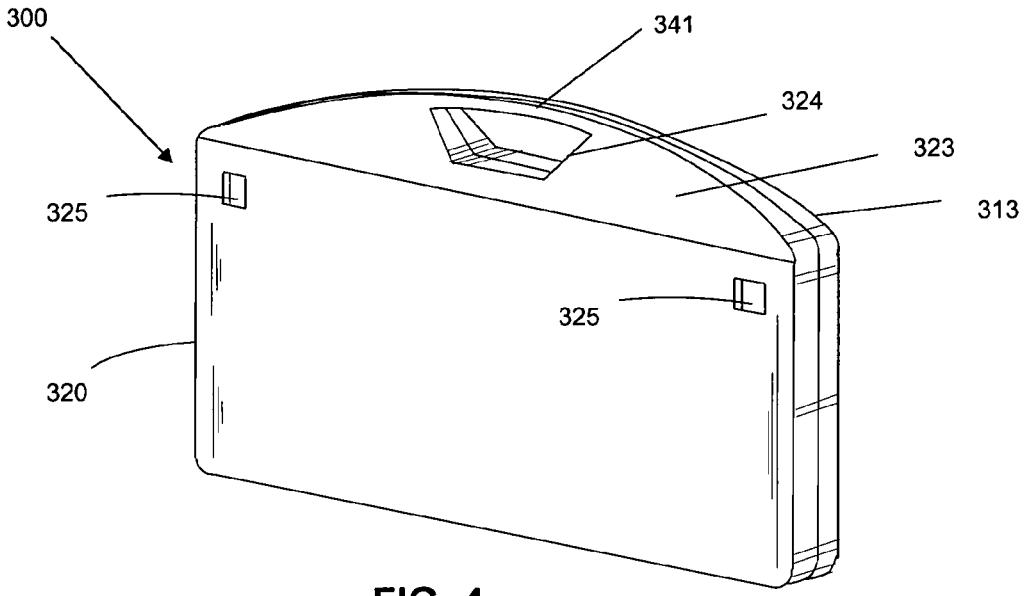
FIG. 4 is a rear and upper perspective view of the cover from its upper section, the cover being built according to the preferred embodiment of the present invention.
Figure 5:
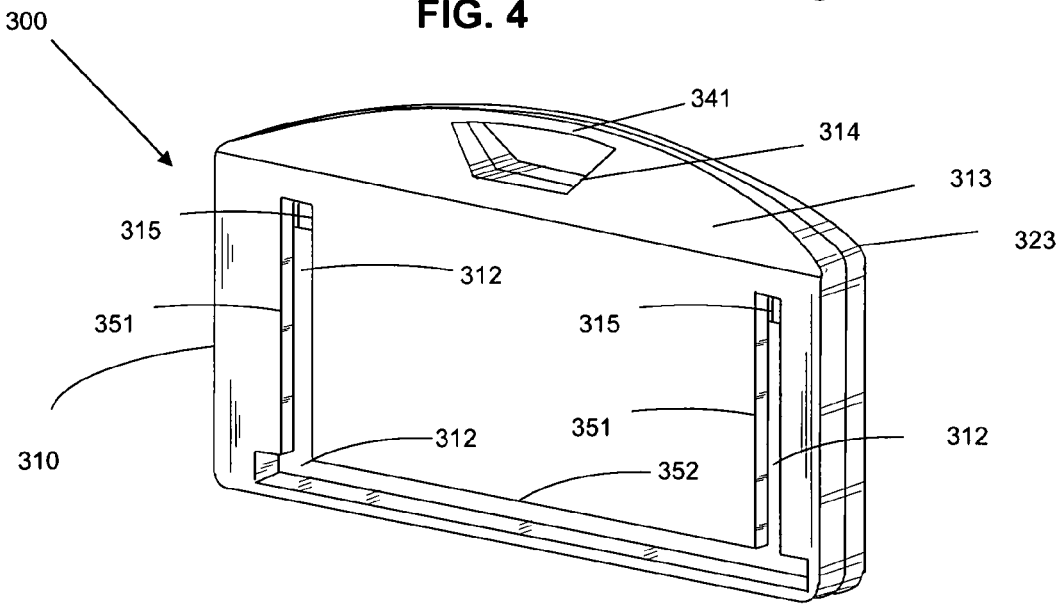
FIG. 5 is a perspective view of the cover illustrated in FIG. 4 from its lower section.

In order to describe a little more the cover 300 of the preferred embodiment of the present invention, reference is made to FIGS. 4 and 5, where it is observed, particularly in FIG. 4, the upper holes 325 of the upper section 320 through which each of the posts supporting the board is inserted.

On the other hand, FIG. 5 shows the lower section 310 including a recess 312 having a shape that follows the path of the upper part of the base, and particularly, it is observed that the recess includes two side sections 351 where the side panels of the base are received, as well as a front section 352 where the front panels of the base are received.

FIG. 5 also shows with more detail the lower holes 315, which are located on the path of the recess 312 so that the post inserted through the upper hole of the cover crosses through all cover 300 and comes out through such lower hole 315 to be inserted in one of the side panels of the base. It is evident that lower hole 315 may be located in a different part of the recess, for example, it may be located at the front section 352 of the recess so that the post can be inserted into one of the front panels.

Likewise, in order to make easier the transportation and handling of the cover, it additionally includes means for holding the cover and load it once the base of the counter is inside the cover, the holding means are provided at any or both sections, lower or upper. Particularly, it is preferred that the holding means is a handle 341 which is formed integrally in the cover 300, although it may be a strap whose ends are attached to the cover.

In order to form such handle, the lower section 310 includes a first extension 313 that is projected outward the cover and which includes a first opening 314, while the upper section includes a second extension 323 that projects outward of the cover, and which includes a second opening 324, in such a way that when the lower section 310 couples with the upper section 320, the first and second extension form the handle 341 by means of said first and second openings 314 and 324.

Figure 6:
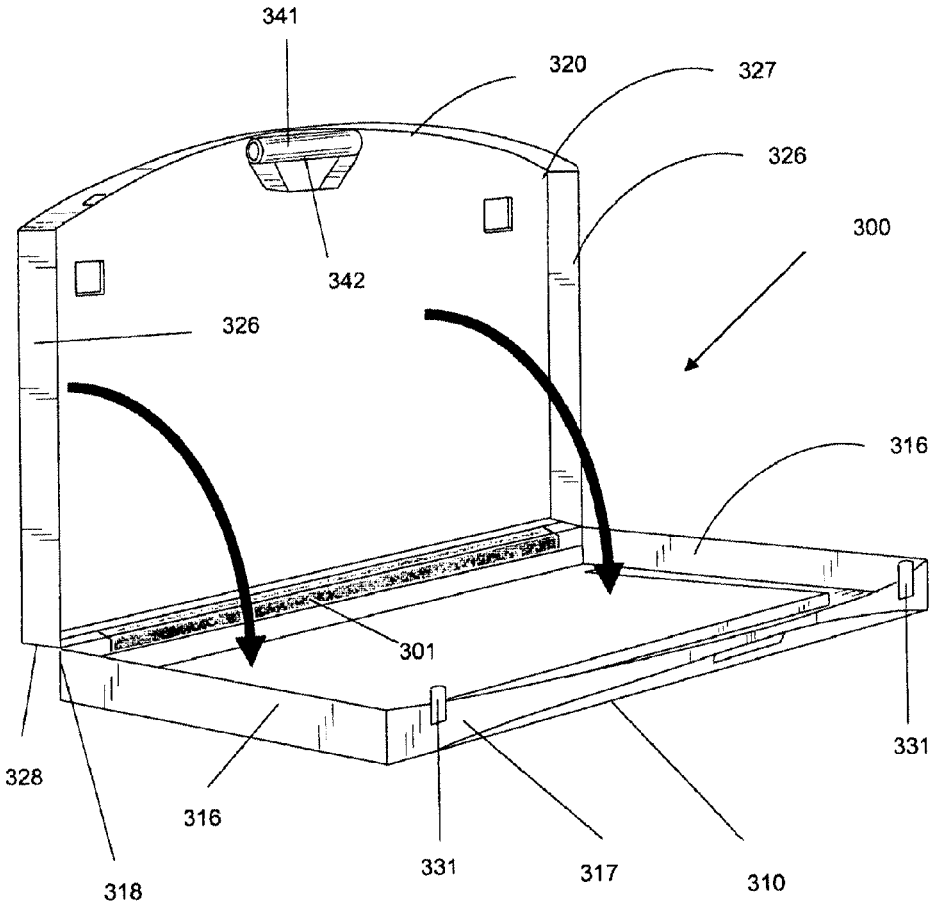
FIG. 6 is a perspective view of the cover shown in FIG. 4, showing its inside.

As per FIG. 6, it is observed that the upper section 320 is hingendly connected to the lower section 310 in such a way that they close one against the other so that the cover 300 becomes a housing where the base is stored in its folded position. The union of the upper section 320 with the lower 310 is done by means of a plastic hinge 301.

The cover 300 additionally comprises locking means in order to lock the lower section 310 with the upper section 320 when the cover is mounted on the base in its upright position or when the cover is stored into the base; the locking means may be provided in any or both sections, lower or upper 310 or 320, in the embodiment that is disclosed, the locking means are formed by pins 331 provided in the lower section 310 and which are inserted in the upper section 320, although locking means may be provided as locks, studs, straps, etc.

FIG. 6 allows observing that in order to make the handle 341 rigid, it includes a reinforcing element 342 that is provided in a tube form and is located within the upper section 320, and this tube may be made of rigid material, like metal.

Each of the cover sections is made of a thermoformable material, and particularly, they are two symmetric halves that have a rectangular shape and they include opposite side walls 316, 326, a front wall 317, 327, and a rear wall 318, 328, where both sections 310 and 320 are hingendly connected by means of the hinge 301, which connects internally the rear wall 318, 328 of both sections.

Figure 7:
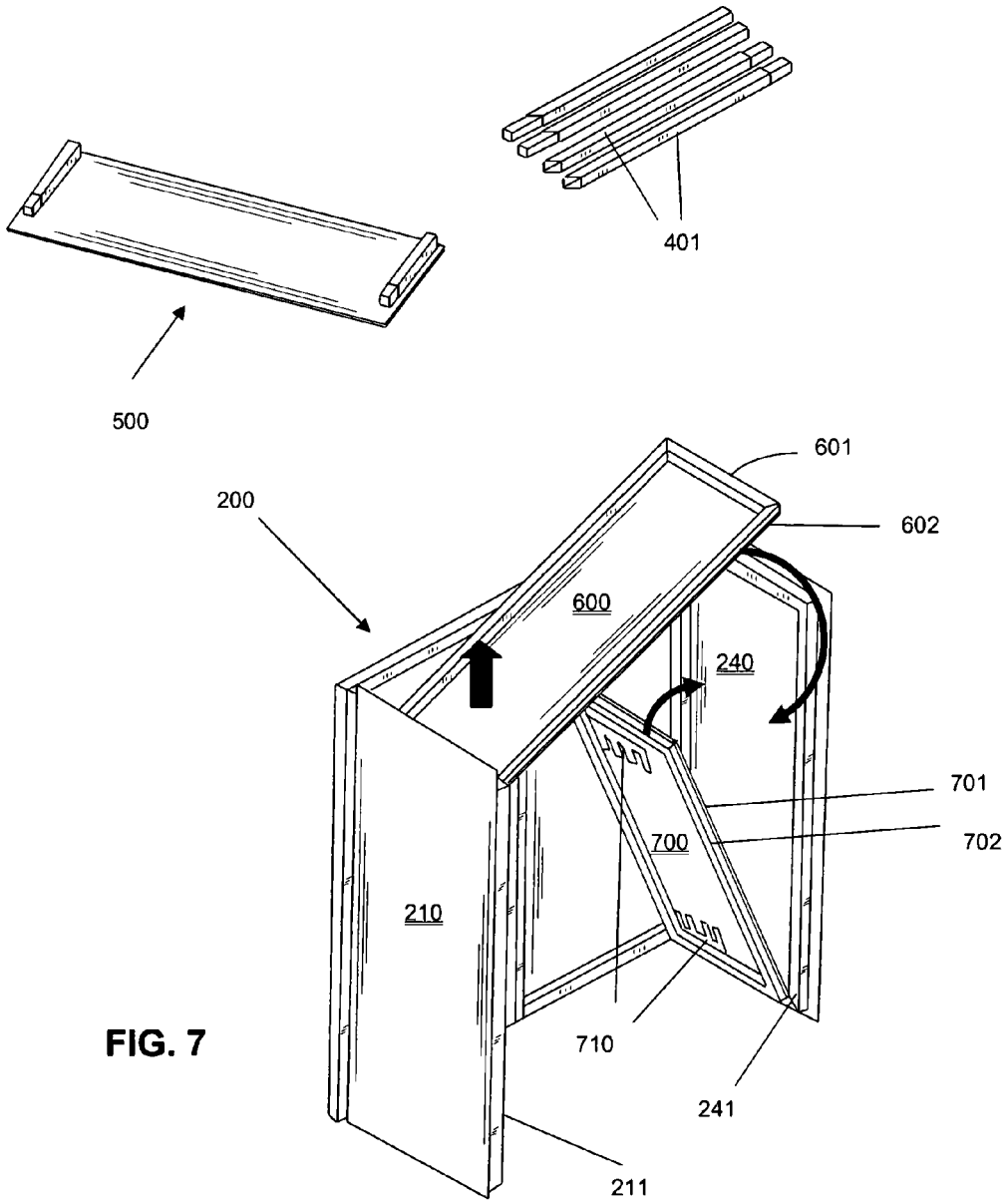
FIG. 7 is a perspective view, where with except of the cover, it is illustrated the other elements of the counter being demounted.

Now, reference is made to FIG. 7, to illustrate as an example, how the base 200 and the other elements of the counter are stored. FIG. 7 shows the board 500 once demounted and the sections 401 of the posts decoupled among them. Inside the base 200, there is an upper shelf 600 and a lower shelf 700 that are mounted between the side panels 210 and 240, of them, the upper shelf 600 is formed by a frame 601 that has a plate 602 assembled; the frame 601 is oriented upwards. The upper shelf 600 is mounted in a sliding and rotating mode to the framework 211 of the left side panel 210, this means that the upper shelf 600 may go up on its left side and, when it is at its highest position, it rotate on such left side in a descending direction to be housed inside said left side panel 210, as shown by the teachings of the international application No. PCT/IB2005/002083.

On the other hand, the lower shelf 700 is formed by the frame 701 and the plate 702 placed on said frame, the lower shelf is hingendly connected to the lower face of the frame 241 of the right side panel 240 in such a way that, when lifting it, the lower shelf 700 is housed inside the right side panel 240, as shown by the teachings of the international application No. PCT/IB2005/002083, cited by reference. The connection of the lower shelf with the frame 241 is achieved by means of a piano-type hinge.

This FIG. 7 shows that the lower shelf 700 includes a pair of supports 710 to place on it the sections 401 by which posts that support the counter board are assembled.

In turn, once the upper shelf 600 is housed, the board 500 may be placed on it to be housed in the left side panel 210. These characteristics are illustrated in the international application No. PCT/IB2005/002083, cited by reference. Emphasis is once again made on the fact that the base 200 is an example on which the cover of the present invention may be placed, since there might be bases 200 without such lower 700 or upper 600 shelves.

Figure 8:
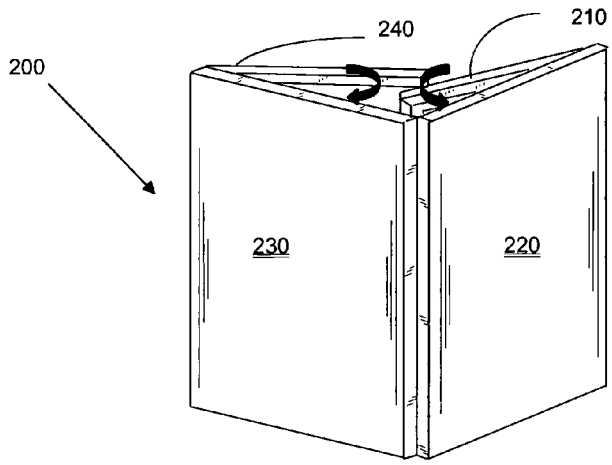
FIG. 8 is a perspective view showing the base that is about to be fully folded.
Figure 9:
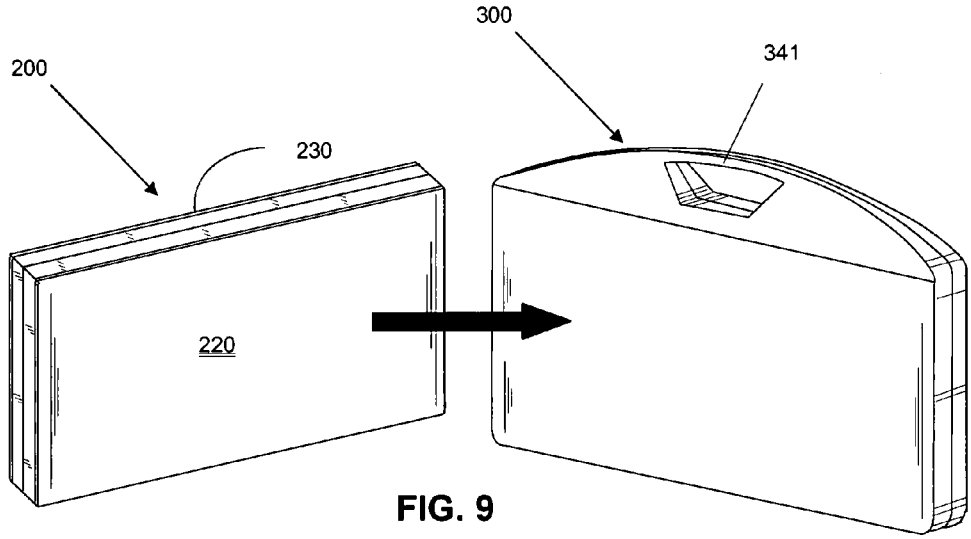
FIG. 9 is an upper perspective view of the base in its folded position to be stored into the cover of the preferred embodiment of the present invention.

Making reference to FIG. 8, it may be mentioned that in order to continue folding the base 200, the right side panel 240 turns inwards in order to be housed inside the right front panel 230, while the left side panel 210 is housed inside the left front panel. At the end of this movement, there are two halves left, which are basically the front panels 220 and 230, which are placed once in front to the other to finally taking the base to its folded position, as it is illustrated in FIG. 9. The folded base may be introduced into the cover 300, which, when closing, allows to transport the whole counter and it may be hanged with the aid of the handle 341. In the cover 300 totally closed, the base is no longer exposed, for which there is no more risk of having damage on the surface which affects its visual appearance.

It is preferred that materials with which the most important elements of the base are manufacture, this is, the side panels, the front ones, doors, shelves and cover are light-weight materials such as polymers, preferably polyvinyl chloride (PVC), although they may be made with other materials, such as wood, cardboard, etc. On the other hand, it is preferred that the cover is made of a thermoformable material, such as PVC, polycarbonate, etc., with which it is possible to give it the desired shapes to the cover.

Even when a preferred embodiment of the invention has been described and exemplified, it should be stressed that several modifications of it are possible, such as the form and length of recess, the way in which the cover sections are joined, the specific form of the cover obtained by thermoforming, etc. Therefore, this invention should not be considered as limited except for what it is required by the prior design and by the scope of the appended claims.

REFERENCE LIST

100 Counter
200 Base
210 Left Side Panel
  211 Frame of the left side panel
  212 Plate of the left side panel
220 Left Front Panel
230 Right Front Panel
240 Right Side Panel
300 Cover
301 Plastic hinge
310 Lower section
  311 Lower face
  312 Recess
  313 First extension
  314 First opening
  315 Lower holes
  316 Side walls
  317 Front wall
  318 Rear wall
  320 Upper section
  321 Upper face
  323 Second extension
  324 Second opening
  325 Upper holes
  326 Side walls
  327 Front wall
  328 Rear wall

331 Pins
341 Handle
342 Reinforcement element
351 Side sections of the recess
352 Front section of the recess
400 Posts
401 Coupling sections of the posts
500 Board
600 Upper shelf
601 Frame of the upper shelf
602 Plate of the upper shelf
700 Lower shelf
701 Frame of the lower shelf
702 Plate of the lower shelf
710 Supports for the coupling sections of the posts

What is claimed is:

1. A combination for a counter comprising:

a foldable base including a left side panel;

a left front panel hingedly connected to the left side panel;

a right front panel hingedly connected to the left front panel; and, a right side panel hingedly connected to the right front panel, wherein the base has an upright position, and a folded position wherein the front panels and the side panels are folded one next to the other in an accordion form a cover being coupled to the base in its upright position and including:

a lower section that has a lower face in which a recess is provided, in which the base is coupled when it is in its upright position; said recess having a shape that follows the path of an upper part of the base, and includes two side sections wherein the side panels of the base are received, and a front section wherein the front panels of the base are received; the lower section including at least one inferior hole located in the path of the recess;

an upper section with an upper face where there is at least one upper hole; the upper section being hingedly connected to the lower section in such a way that they close one with the other so that the cover becomes a housing, in which the base is stored in its folded position; and a post inserted into the upper hole, crossing all the cover and coming out from the inferior hole of the lower section to be inserted into the front panel or any of the side panels of the base.

2. A combination for a counter, according to claim 1, further comprising means for locking the lower section with the upper section when the cover is mounted on the base in its upright position or when the base is stored in the base, the locking means being provided in any or in both sections, lower or upper.

3. A combination for a counter according to claim 2, wherein said locking means are pins provided in the lower section and inserted in the upper section.

4. A combination for a counter according to claim 2, wherein it further comprises means for holding the cover in order to load it once the base of the counter is stored in the cover; the holding means being provided in any or both sections, lower or upper of the cover.

5. A combination for cover for counter according to claim 4, wherein said holding means are a handle.

6. A combination for a counter, according to claim 5, wherein the handle is integrally formed in the cover.

7. A combination for a counter according to claim 6, wherein the lower section further includes a first extension that is projected outward of the cover and is provided with a first opening, while the upper section includes a second extension that is projected outward of the cover and is provided with a second opening so that when the lower section is coupled with the upper section the first and second extension couple each to other forming the handle by means of such first and second openings.

8. A combination for a counter, according to claim 7, wherein the handle comprises a reinforcing element provided within the upper section.

9. A combination for a counter according to claim 1, wherein both sections of the cover are made of a thermo formable material.

10. A combination for a counter, according to claim 1, wherein both sections of the base are two halves that have a rectangular shape including opposite side walls, a front wall and a rear wall, wherein both sections join together by means of a hinge that internally connects the rear wall of both sections.

* * * * *